United States Patent [19]

Herbstler et al.

[11] Patent Number: 4,563,163

[45] Date of Patent: Jan. 7, 1986

[54] STAND UP DOLL

[75] Inventors: Horst-Dieter Herbstler, Bolingbrook; Rouben T. Terzian, Chicago, both of Ill.; Lewis R. Dyson, Milford, Ohio

[73] Assignee: Marvin Glass & Associates, Chicago, Ill.

[21] Appl. No.: 696,173

[22] Filed: Jan. 29, 1985

[51] Int. Cl.[4] ..... A63H 13/00

[52] U.S. Cl. ..... 446/354

[58] Field of Search ..... 446/354, 353, 352, 351, 446/355, 330, 324, 325, 356

[56] References Cited

U.S. PATENT DOCUMENTS

| | | | |
|---|---|---|---|
| 3,494,323 | 2/1970 | Ayala et al. | 446/352 X |
| 4,073,088 | 2/1978 | Beny et al. | 446/354 |
| 4,266,367 | 5/1981 | Kuna et al. | 446/354 X |
| 4,312,150 | 1/1982 | Terzian | 446/354 |
| 4,349,987 | 9/1982 | Bart | 446/355 |
| 4,386,479 | 6/1983 | Terzian et al. | 446/351 X |
| 4,467,555 | 8/1984 | Terzian et al. | 446/355 X |

FOREIGN PATENT DOCUMENTS

| | | | |
|---|---|---|---|
| 1321120 | 6/1973 | United Kingdom | 446/324 |

*Primary Examiner*—Mickey Yu

*Attorney, Agent, or Firm*—John S. Pacocha

[57] ABSTRACT

A motor driven doll that rises from a face-down prone position to an erect standing position. Cam followers drive first one leg from an extended position behind the torso of the doll to a more forward position and then similarly drive the other leg to bring the doll to a splayed leg crouching position. Thereafter, simultaneous movement of the cam followers rotate the torso relative to both of the legs at the same time to raise the doll to an erect standing position. As the second leg is being moved from the rearward extended position, a third cam drive pivots the head rearwardly to shift the center of gravity and assist in raising the doll. As the doll reaches a fully erect position the head is driven to a forward position and, at the same time, a fourth drive effects a swiveling of the head so that the doll displays a pert glance of accomplishment.

19 Claims, 15 Drawing Figures

STAND UP DOLL

BACKGROUND OF THE INVENTION

1. Field of the Invention

This invention relates to mechanical dolls and, in particular, to mechanical dolls which are capable of rising from a prone position to a standing position.

2. Background Art

Mechanical dolls that are capable of realistically performing an action such as walking, or swimming, are disclosed in U.S. Pat. Nos. 4,386,479 and 4,467,555, respectively, are included in the prior art. Also included in the prior art is the doll disclosed in U.S. Pat. No. 4,266,367 which is capable of moving from a standing to a sitting position. Dolls which move from a prone face down position to an upright standing position are disclosed in prior U.S. Pat. Nos. 4,312,150 and 4,349,987. There remains a need, however, for a doll which mechanically rises from a prone position to a standing position in a live-like manner emulating the action of an infant first proudly accomplishing such task.

SUMMARY OF THE INVENTION

The present invention is concerned with providing an articulated doll that is driven from a face-down, prone position to an upright standing position. This and other objects and other advantages of the invention are achieved by providing the doll with a pivotally mounted head and legs and a drive mechanism in which the legs are driven, first one at a time, from an extended position behind the torso of the doll to a more forward position and the doll is then further driven to rise to a generally upright erect standing position while the head is pivoted from an initial forward position to a rearward position and then back to a forward position in coordination with the leg movements to assist in raising of the doll. In addition, the head is swiveled sidewardly in the final pivotal movement from the back to the front as the doll rises to the erect position to display a pert glance of accomplishment.

BRIEF DESCRIPTION OF THE DRAWINGS

For a better understanding of the present invention reference may be had to accompanying drawings in which.

DESCRIPTION OF THE PREFERRED EMBODIMENT

Figure 9:
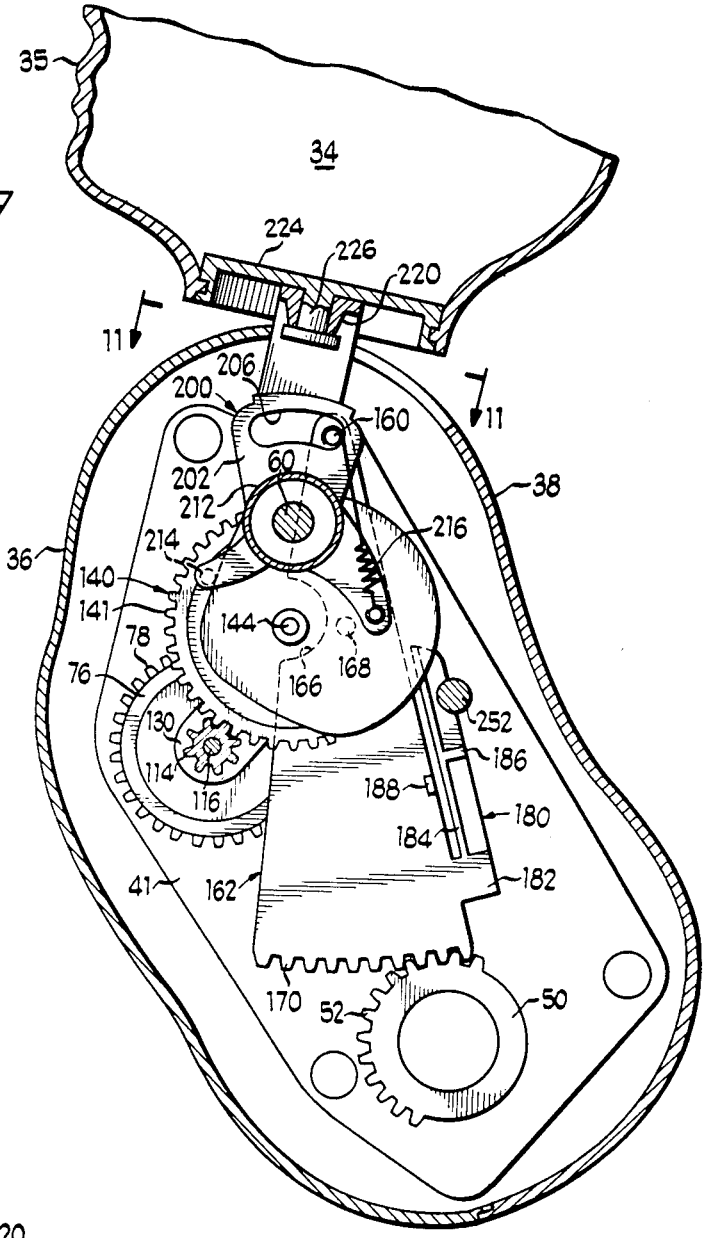
FIG. 9 is a sectional view taken generally along the line 9—9 of FIG. 6.

Referring now to the drawings in which like parts are designated by like reference numerals throughout the several views there is shown in FIGS. 1A–D a doll 20 in various positions in its sequence of movement in rising from a face-down prone position upon a generally horizontal surface 22 to an upright standing position on the same surface. Doll 20 has a torso 24 adjacent the lower end of which are attached a left leg 26 and a right leg 27 for driven pivotal movement with respect to the torso. Each of the legs has a respective left foot 28 and right foot 29 with a substantially flat bottom. A weight (not shown) may be placed within each foot to increase stability of the doll in the standing position. Also attached for free pivotal movement with respect to the torso are left arm 32 and right arm 33 adjacent the upper end of the torso 24. Atop the torso is a head 34 with a face 35 mounted for driven pivotal movement between a front and back position.

Figure 1A:
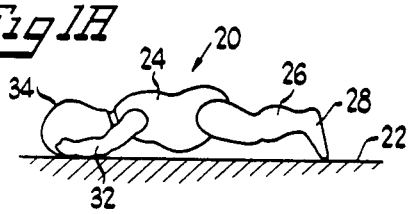
FIG. 1A is a schematic showing of a doll embodying the present invention in a face-down prone position.
Figure 1B:
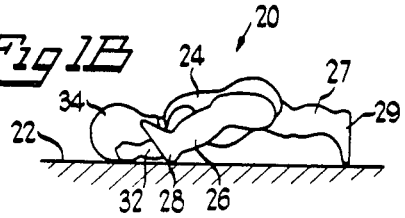
FIG. 1B is a schematic showing of the doll after the left leg has been pivoted from the rearward extended position to a more forward position alongside the torso.
Figure 1C:
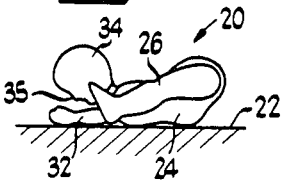
FIG. 1C is a schematic showing of the doll in a crouched position after the right leg has been pivoted from a rearward extended position to a more forward position alongside the torso.
Figure 1D:
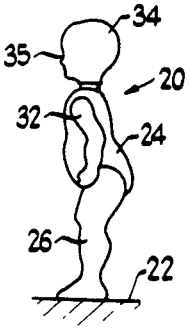
FIG. 1D is a schematic showing of the doll after it has assumed its upright standing position.

As shown in FIG. 1A the doll 20 is in an initial face-down, prone position on the horizontal surface 22 with part of the front of head 34 and the toe portions of feet 28 and 29 as well as the hand and forearm portions of each of arms 32 and 33 contacting the horizontal surface. After the first step or phase, left leg 26 will, as shown in FIG. 1B, have been driven from its initial rearwardly extending position generally aligned with the length of torso 24 and with foot 29 behind the lower end of the torso and the pivotal axis of the leg to a second position alongside the torso with the foot ahead of the leg axis and at least a portion of the foot 29 contacting the surface 22 along the inside edge. Right leg 27 is then driven through a similar pivotal sequence bringing the doll 20 to a crouching position like that shown in FIG. 1C. During the pivotal movement of leg 26, the head remains in the forwardmost position. However, during the movement of right leg 27, head 34 is pivoted from the forwardmost position shown in FIG. 1A to a rearmost position shown in FIG. 1C. This pivoting of the head assists in shifting the center of gravity of the doll 20 toward the rear of the doll. Continued driven simultaneous pivotal movement of both of legs 26 and 27 relative to torso 24 results in rotating the torso away from the first and second legs in their second position back to the first, generally aligned, positional relationship of the legs and torso effectively raising the doll 20 to a generally upright erect standing position with the bottoms of feet 28 and 29 supporting the doll on surface 22 as illustrated in FIG. 1D.

Torso 24 is formed of a front shell half 36 and a rear shell half 38 covering left and right internal frame plates 40 and 41, respectively. Frame plates 40 and 41 support the pivotal mounting of the legs and arms as well as head 34 and also house the motor and drive mechanism. Adjacent the lower portion of each of the frame plates there is an outwardly and downwardly extending integral socket 44. Rotatably received within each socket 44 is a leg mount 46. The outer portion 47 of each of the leg mounts 46 snaps into a leg mounting disk 48 that is keyed into an annular groove molded into each of the legs. Disk 48 resiliently engages a detent 49 on portion 47 for rotation with the leg mount under a normal load but provides a clutching action to protect the drive mechanism when abusive loads are applied to the legs. A generally annular flange 50 of a diameter larger than that of the interior of socket 44 is formed on the inner end of each mount 46. In assembly, mount 46, whose outer end 47 is of a smaller diameter than that of the interior of hollow socket 44, is inserted from the interior side of respective plate 40 or 41. After disk 48 is snapped onto outer end 47, mount 46, though free to rotate or pivot within socket 44, is retained against removal. Annular flange 50 includes a gear segment 52. A weight 54 is secured in the bottom of rear shell 38 to counterbalance the head, motor and drive mechanism.

Figure 6:
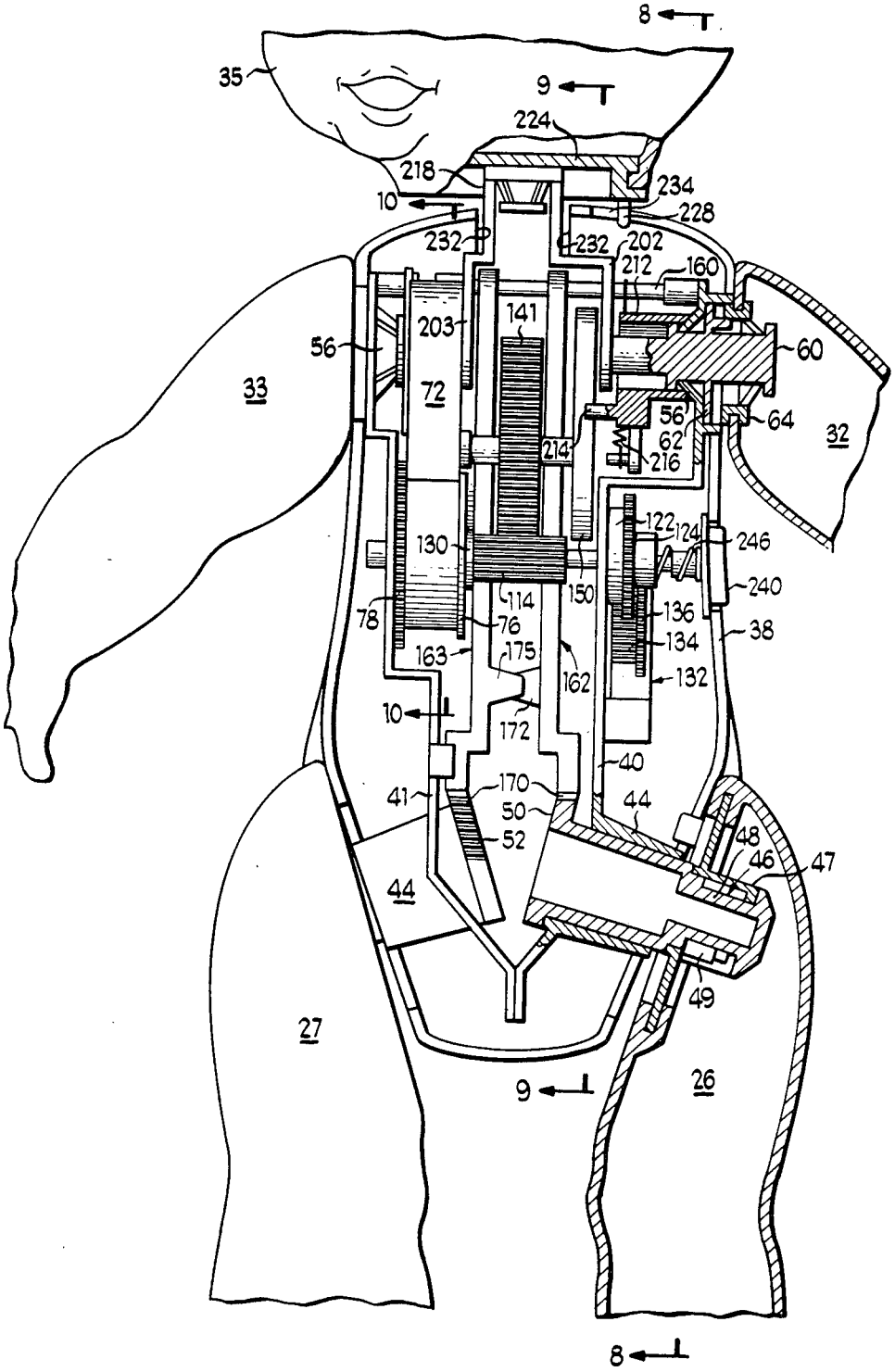
FIG. 6 is a fragmentary front plan view of the doll partially in section.
Figure 7:
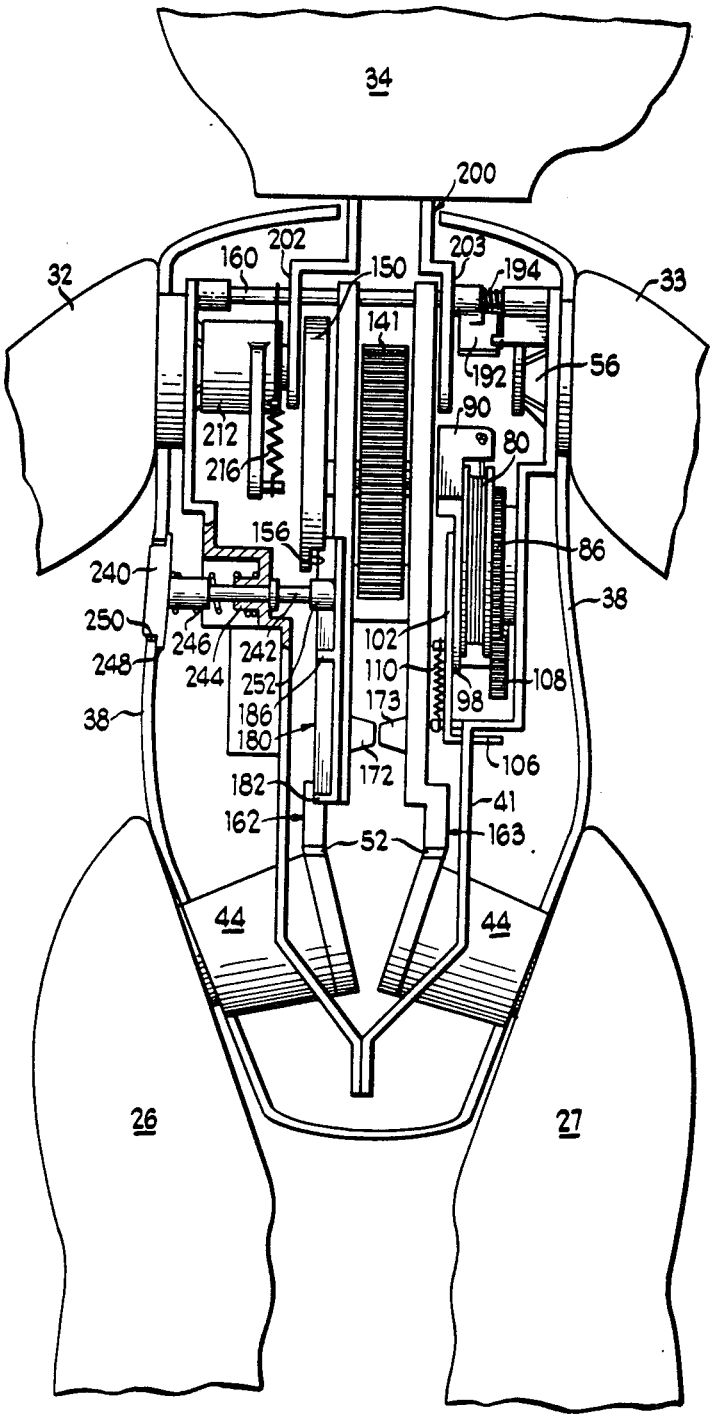
FIG. 7 is a rear plan view of the doll with the rear shell of the torso removed.
Figure 8:
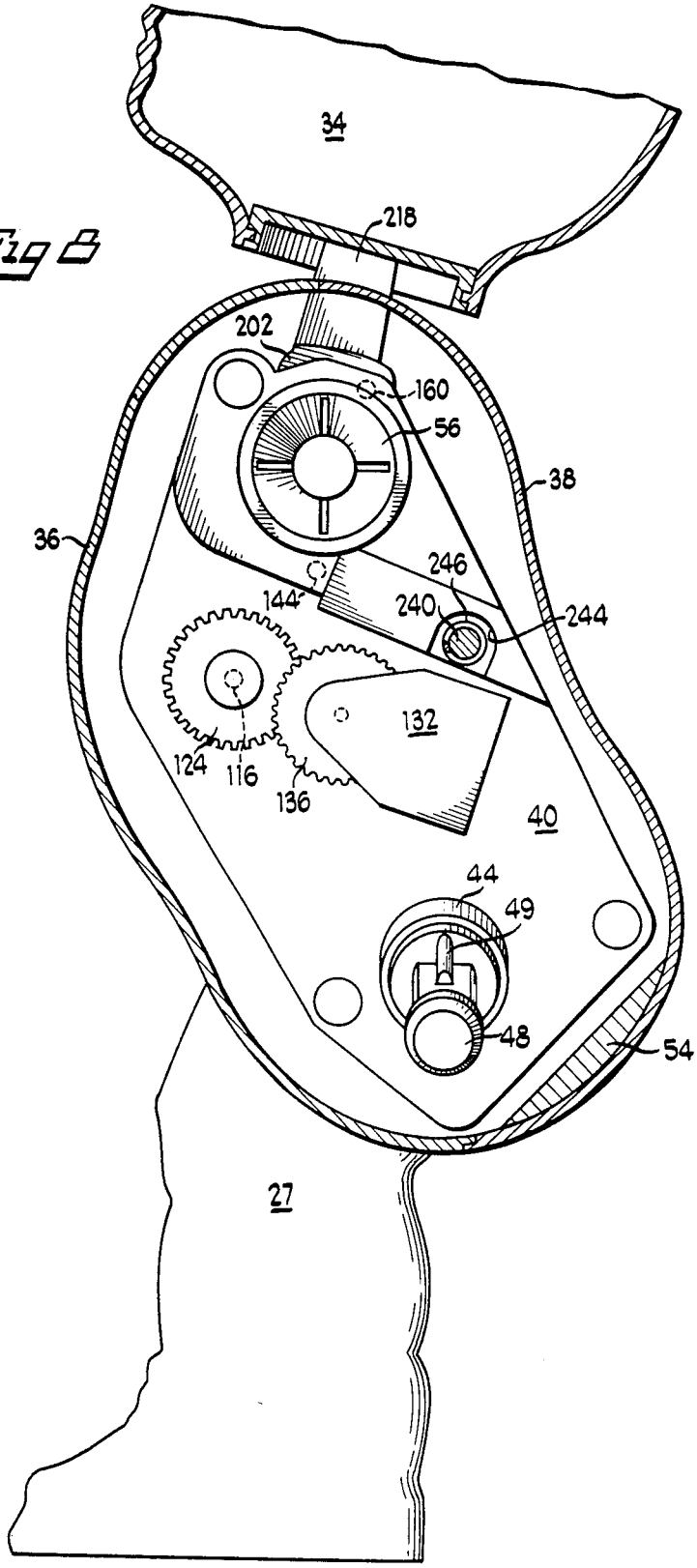
FIG. 8 is a sectional view taken generally along the line 8—8 of FIG. 6.

Adjacent the upper end, each frame plate 40 and 41 is provided with a cross-slotted inwardly curved shoulder pin support 56. Insertable into central aperture 58 is a shoulder pin 60 having a stop flange 62 intermediate the ends of the pin. The inserted pin 60 is retained against extraction by the compression of the slotted portions of the curved mount 56. Mounted for rotation on the outwardly extending portion of pin 60 is an arm shoulder retaining ring 64 which is best illustrated in FIG. 6. Ring 64 has a generally C-shaped cross section which receives and retains portions of one of the arms 32 or 33 around the periphery of an aperture into which the retaining ring 64 fits. Arms 32 and 33 are formed of a resilient material and the fit between retaining ring 64 and the respective arm is sufficiently tight so that the arm is substantially fixedly attached to the ring 64. However, ring 64 freely rotates about the pin 60 resulting in arm 32 or 33 being freely rotatable with respect to the respective frame plate 40 or 41 as well as torso 24.

Housed within torso 24 between plates 40 and 41 is a negator spring motor 70. One end of a coiled negator spring 72 is secured to drum 74 which stores the spring for use. The other end of the spring is secured to spool 76 which has an integral coaxial drive gear 78. Pull string 80 has one end attached to pulley 82 which has an internal flat coiled spring 84 to keep the string tightly wound around the pulley. Integral and coaxial with pulley 82 is a gear 86. String 80 extends through a small eyelet opening 88 on friction clutch tab 90 and then through an opening in the torso back shell half 38 and terminates in a finger loop 94.

Friction clutch tab 90 is part of a lever 98 mounted for pivotal movement on axle 100 on which pulley 82 is rotatably mounted. One end of axle 100 is journaled in the right frame plate 41 and the other end is supported by L-shaped bracket 102. Slot 104 in frame plate 41 receives a bent end 106 of L-shaped piece 102. Lever 98 carries a winding gear 108 mounted on a stub shaft 109 extending from the side of the lever at the end opposite tab 90. Winding gear 108 is always in engagement with gear 86 on pulley 82. Small tension spring 110 biases the lever to normally keep gear 108 out of engagement with drive gear 78 on spool 76. However, as string 80 is pulled, the friction between the string and small eyelet opening 88 is sufficient to pivot lever 98 against the bias of small spring 110 and move winding gear 108 into engagement with gear 78 to rotate spool 76 unwrapping negator spring 72 from storage drum 74. When string 80 is released and rewound upon pulley 82 by means of flat coiled tension spring 84, tab 90 is released and tension spring 110 biases gear 108 back out of engagement with gear 78.

After negator spring 72 is wrapped around spool 76 the potential energy obtainable from the tendency of the negator spring to rewind itself about drum 74 will drive power gear 114 on shaft 116 through torsion spring clutch 118 which engages spool 76 also mounted for rotation on shaft 116. One end of shaft 116 is journaled for rotation in plate 41 and the other end extends through the integrally formed sleeve 122 on plate 40. Cap gear 124 which is integrally formed on a hollow axle 126 is secured on the extending end of shaft 116 for rotation with that shaft and hollow axle 126 is rotatably received in sleeve 122. Shaft 116 passes through and readily rotates within an aperture 128 in the end 130 of L-shaped bracket arm 102. Mounted on the outside of frame plate 40 is a governor 132 for regulating the drive speed of motor 70 and which includes gear 134 that engages gear 124. Governor 132 is of the centrifugal drum brake type driven by gear 136 through coaxial gear 134. However, other governors of conventional design could be employed.

Figure 4:
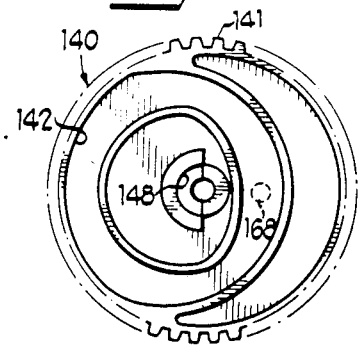
FIG. 4 is an enlarged scale elevational view of one side of the combination gear showing the face cam grooves controlling the movement of the left leg of the doll.
Figure 5:
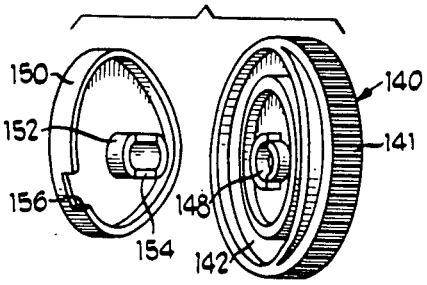
FIG. 5 is a perspective view of the cooperating faces of the combination gear and edge cam.

Torsion spring clutch 118 provides engagement between spool 76 and shaft 116 of which the power transmission gear 114 is an integral part only when negator spring 72 is unwinding back onto drum 74. While spring 72 is being wound from drum 74 onto spool 76 torsion spring clutch 118 slips and gear 114 on shaft 116 is not rotated by spool 76. In constant driving engagement with power transmission gear 114 is a combination gear and double-faced cam 140 provided with peripheral gear teeth 141, a left cam groove 142 on one face and a right cam groove 143 on the opposed face. Combination gear-cam 140 is mounted for rotation on axle 144 extending through the central hub 146. As is best shown in FIGS. 4 and 5, the left side of hub 146 is formed with a semicylindrical key 148. Also mounted for rotation on axle 144 is a three-lobe edge cam 150 which has a hub 152 with a semicylindrical key 154 on the right side that engages key 148 on the left side of the combination gear face cam 140. Thus, cam 150 and the combination gear-cam 140 are always in the same fixed angular relationship. Cam 150 has a notch 156 in the edge along the inside face. Axle 144 is seated in inwardly directed supports 158 and 159 on frame plates 40 and 41, respectively.

Pivotally mounted on a rod 160 above and on either side of combination gear-cam 140 are left and right gear followers 162 and 163, respectively. Rod 160 extends through an aperture 164 adjacent the upper end of each of the followers. A semicircular cut-out 166 on the forward edge of each of the gear followers accommodates hub 146 of combination gear-cam 140. Rearward of the semicircular indentation each of the left and right followers has an integral, inwardly directed, cam groove follower pin 168 and 169, respectively. On the lower circular edge of each of the cam followers 162 and 163 there is a sector gear 170. Intermediate the cam groove follower pin and the sector gear there is an inwardly directed spacer rib 172 and 173 on the left and right hand cam followers, respectively. Ribs 172 and 173 maintain the lower portions of the cam followers spaced apart to insure engagement of the sector gears 170 with gear segments 52 on leg mounting members 46. In addition, right cam follower rib 173 has an inwardly directed stop 175 on the forward edge which abuts rib 172 on the left cam follower.

Left cam follower 162 has an integrally formed releasable latch 180 attached to the follower only near the bottom end 182. The latch is otherwise spaced from the rearward edge of cam follower 162 and is angled toward the outside of the cam follower. Latch 180 is generally L-shaped in cross section with one portion of the "L" forming a lip 184 that is substantially parallel to the back edge of the cam follower. Intermediate the attached end and the free end there is a transverse support brace 186. Follower 162 also has an integrally formed safety stop tab 188 which provides support for the intermediate portion of the latch when it is compressed toward the edge of the follower.

The outward bias of latch 180 causes the underside of lip 184 to ride upon the edge of cam 150 until notch 156 appears under the free end of arm 180. Lip 184 will drop into the notch and arrest further rotation of the cam 150 and combination gear-cam 140. With the rotation of cam 150 and the combination gear-cam 140 arrested by releasable latch 180, the unwinding of spool 76 is also arrested so that spool 76 may be fully loaded with negator spring 72 from drum 74 by repeated pulls on string 80.

Mounted for pivotal movement on rod 160 adjacent the wrapped portion of negator spring 72 on the cylindrical surface of drum 74 is a tab 192. A torsion spring 194 that is also carried on rod 160 biases tab 192 in toward the negator spring and drum. As negator spring 72 is loaded from drum 74 onto spool 76, tab 192 under urging of the torsion spring 194 stays in contact with the portion of the negator spring still on the drum. However, when the spring is almost completely unwound from drum 74, tab 192 is urged into notch 196 on the exposed cylindrical surface of the drum to stop further unwinding of spring 72 from the drum.

A head mounting bracket 200 is pivotally mounted on the inner side of each of the shoulder pins 60. Spaced apart, left and right, downwardly depending uprights 202 and 203, respectively, have a circular aperture 204 near the bottom that fits over one of the pins 60. Adjacent the upper edge of each of the uprights 202 and 203 there is an arcuate aperture 206 that accommodates rod 160. Left upright 202 also includes a lateral projection 208 which engages a notch 210 in a head cam follower 212. As is shown in FIG. 6, cam follower 212 rotatably rides on the left curved shoulder pin support 56 and on shoulder pin 60. Adjacent one end of follower 212 is a laterally extending pin 214 that is biased by extension spring 216 to follow the edge of the three-lobe head cam 150. The upper bridging platform 218 of the bracket 200 has a depending sleeve 220.

Figure 11:
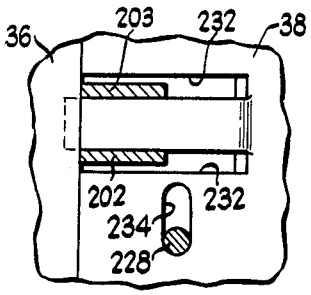
FIG. 11 is a sectional view taken generally along the line 11—11 of FIG. 9.
Figure 3:
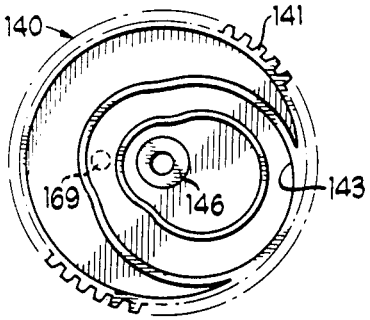
FIG. 3 is an enlarged scale elevational view of one side of the combination gear showing the face cam grooves controlling the movement of the right leg of the doll.

Head 34 is secured to a disk 224 with a central depending post 226. Disk 224 also has an offset depending peg 228 adjacent the periphery. Post 226 is received for rotatable movement within sleeve 220 but is restrained from displacement in an axial direction. Rear shell 38 of the torso has a pair of spaced slots 232 each of which accommodates the back and forth pivotal movement of one of the uprights 202 and 203 of head mounting bracket 200. On the outside portion of the shell to one side of slots 232, there is a channel 234 that is elongated in a direction generally transverse to the length of slots 232. Offset peg 228 rides in channel 234. As head cam 150 rotates, pin 214 follows the edge contour of the edge of the cam causing follower 212 to oscillate with projection 208 engaging notch 210 to drive bracket 200 and head 34 back and forth. When head 34 is in its rearmost pivoted position, the offset peg engaging channel 234 cams or turns the doll's face 35 to the right. However, as head 34 pivots forward to the position shown in FIGS. 9 and 11, offset peg 228 rides back in channel 234 to turn the face back toward the front.

Figure 12:
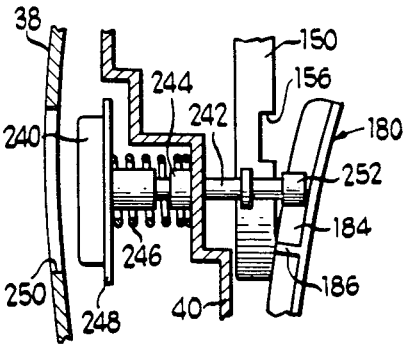
FIG. 12 is a fragmentary sectional view of the control button on the left hand side of the doll.

In order to release the drive mechanism it is necessary to disengage latch 180 or more particularly lip 184 from notch 156 of the three-lobe cam 150. The doll is provided with a release button 240 for this purpose. Push-button 240 is secured to a finger 242 which is received for axial movement within a sleeve 244 integrally formed as part of left frame plate 40. Coil spring 246 biases the push-button and finger outwardly exposing the push-button through an opening 250 in rear shell half 38 with a back flange 248 of the push-button 240 abutting the inside of shell 38. The end of finger 242 opposite the button 240 is formed with a flat circular tip 252 that engages releasable latch 180. When button 240 is pushed inwardly as illustrated in FIG. 12, latch 180 is deflected toward the interior of the doll disengaging lip 184 from notch 156 permitting the entire drive mechanism to begin a cycle. Upon release of button 240 the inherent bias of latch 180 together with bias of spring 246 returns push-button 240 and the releasable latch rides against the edge along the inside face of cam 150. After the cam makes one full revolution or cycle, notch 156 is again engaged to arrest the entire drive mechanism.

Figure 2:
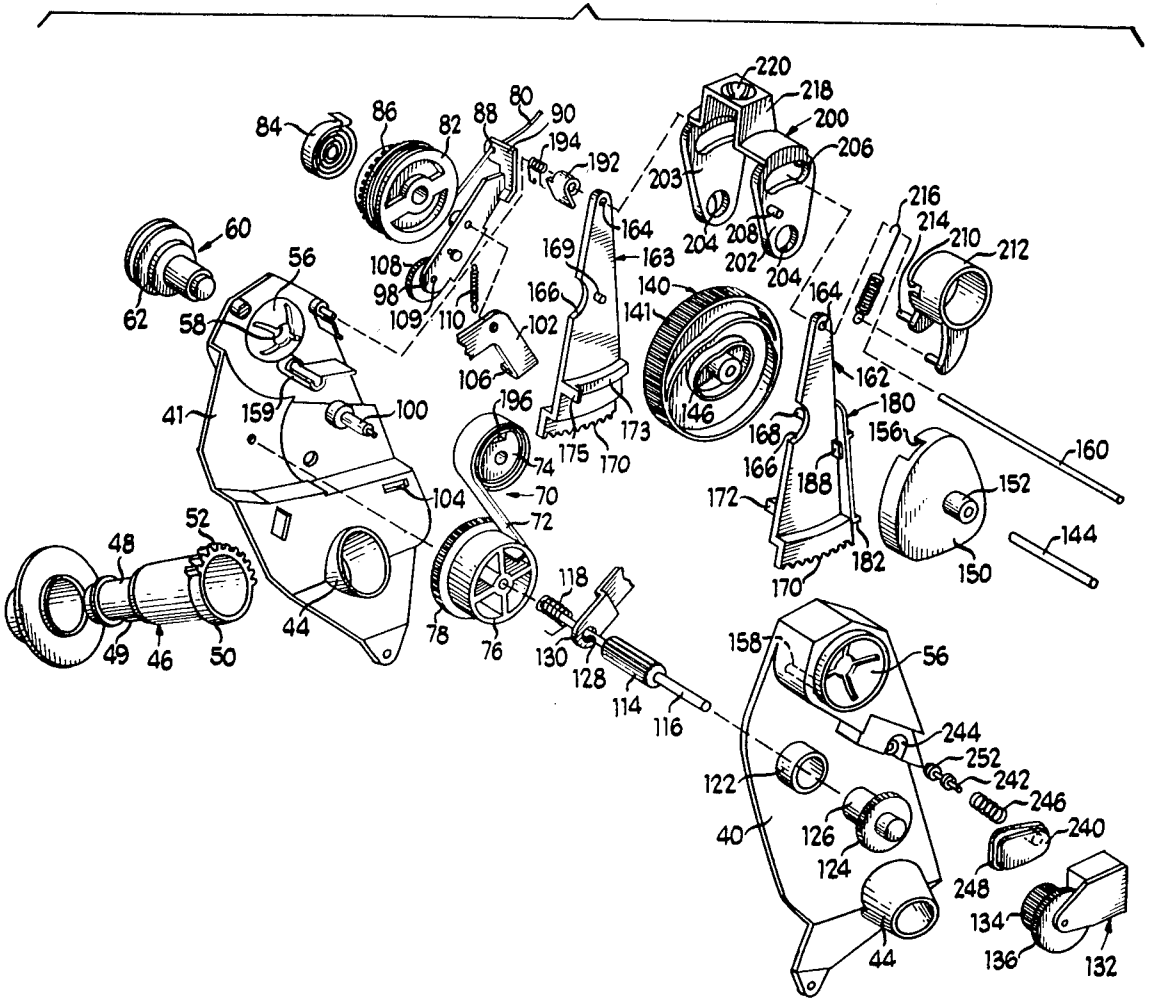
FIG. 2 is an exploded parts perspective view of the internal mechanism of the doll.
Figure 10:
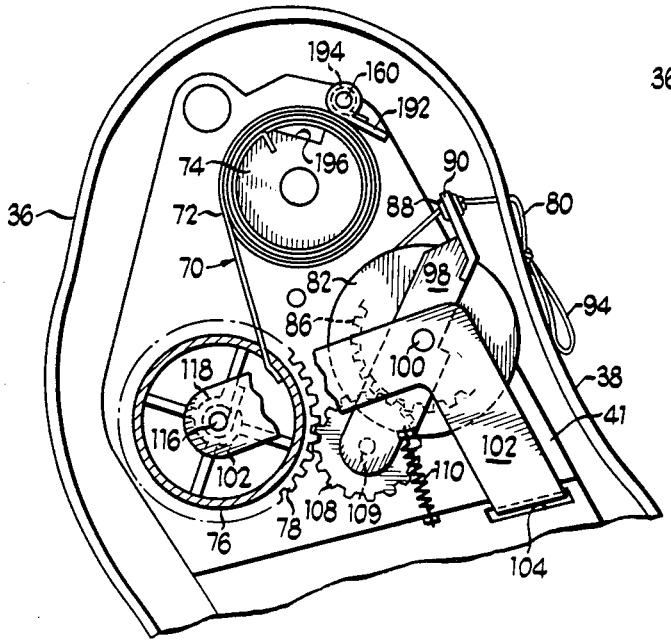
FIG. 10 is a sectional view taken generally along the line 10—10 of FIG. 6.

In operation, negator spring motor 70 is energized by repeated pulls on string 80 and the doll is then placed in a face-down prone position with the freely rotatable arms generally falling in a forwardly outstretched position. The drive mechanism is then released through push-button 240 initiating complete cycle or revolution of the drive mechanism. As combination gear-cam 140 together with the three-lobe cam 150 begin to rotate in a clockwise direction, as the parts are shown in FIGS. 2 and 9, left follower 162 will, with pin 168 following cam groove 142, move rearwardly. Sector gear 170 on left follower 162 engages gear segment 52 on mounting member 46 for left leg 26 to drive the left leg from the rearwardly extended position generally aligned with the length of the torso as shown in FIG. 1A along the surface 22 to a position alongside the torso with the foot ahead of the axis of the leg mounting member. During the movement of left leg 26, right follower 163 and leg 27 dwell. In the next phase, left follower 162 dwells while right follower 163 is driven rearwardly by pin 169 following cam groove 143 causing sector gear 170 to drive gear segment 52 on the mounting member for right leg 27. Thus, the right leg is pivotally driven from the rearwardly extended position shown in FIG. 1B to a position alongside the torso with the foot of the right hand leg ahead of the axis of the right leg mounting member 46 bringing the doll into a splayed leg position like that illustrated in FIG. 1C. At this point, stop tab 175 has abutted the end of rib 172 on left follower 162. Thereafter, both of the followers 162 and 163 are driven by the engagement of the pins 168 and 169 in the respective cam grooves 142 and 143 to rotate the torso away from both of the legs 26 and 27 at the same time to bring the doll to the upright standing position illustrated in FIG. 1D.

During the first movement of the left leg, cam 150 is in a dwell phase so that there is no driven movement of head 34. However, when the driving of the right leg starts, the head is pivotally driven by cam 150 and follower 212 to the rearward position. As the torso begins to rotate away from the legs the head is in its rearmost position to help shift the center of gravity. The head remains in the rearmost position as the doll is raised up by the rotation of both of the legs relative to the torso. When the doll is finally raised to the upright position, the head is then driven pivotally back to its forwardmost position.

Pivotal movement of the head to the rearmost position also turns the head from facing front to one side by engagement of peg 228 in channel 234. When the doll is raised to its erect standing position and the head is driven pivotally back to the forwardmost position, the head and face turn back to face front again by the reverse engagement of peg 228 in channel 234 to display the pert glance of accomplishment.

While a particular embodiment of the invention has been shown and described, it will be apparent to those skilled in the art that changes and modifications may be made without departing from the invention. It is intended in the appended claims to cover all such changes and modifications that fall within the true spirit and scope of the invention.

What is claimed as new and desired to be secured by Letters Patent is:

1. A doll movable from a face-down prone position on a generally horizontal surface to an upright standing position on the generally horizontal surface comprising:

an elongated torso having an upper end and a lower end;

a motor and drive mechanism housed in the torso;

a pair of legs, each mounted at one end of the leg adjacent the lower end of the torso for pivotal movement with respect to the torso about a leg axis transverse to the length of the torso;

the other end of each leg being formed with a foot having a generally flat bottom;

the foot of each leg being behind the respective leg axis when the doll is in the prone position and forward of the respective leg axis in a sitting type position;

a pair of arms, each mounted adjacent the upper end of the torso for pivotal movement with respect to the torso about an arm axis transverse to the length of the torso;

a head mounted atop the upper end of the torso for pivotal movement about a head pivoting axis;

the drive mechanism including first, second and third drive means;

the first drive means initially pivoting a first one of the legs from a first position generally parallel to the length of the torso and with the foot behind the leg axis to a second position alongside the torso with the foot ahead of the leg axis and at least a portion of the foot contacting the surface;

the second drive means then pivoting the second leg from a first position generally parallel to the length of the torso and with the foot behind the leg axis to a second position alongside the torso with at least a portion of the foot contacting the surface ahead of the leg axis;

the first and second drive means together next rotating the torso away from the first and second legs in the second position back to the generally aligned first position; and the third drive means pivoting the head from a first forward position to a second rearward position during movement of the first and second legs from their respective first position to their respective second position to assist in shifting the center of gravity of the doll rearward for moving the doll to the upright standing position when the first and second drive means together rotate the torso back to the generally aligned first position and then returning the head from the second rearward position back to the first forward position upon the first and second drive means rotating the torso back to the generally aligned first position with respect to both of the legs.

2. The doll of claim 1 in which:

the head is also mounted for side-to-side swiveling movement about a head swiveling axis that is not parallel to the head pivoting axis; and the drive mechanism includes fourth drive means to swivel the head upon the third drive means pivoting the head from the second rearward position to the first forward position.

3. The doll of claim 1 in which the drive mechanism includes:

an axle;

first cam means mounted on the axle for moving the legs; and second cam means mounted on the same axle for moving the head.

4. The doll of claim 1 in which the two arm axes and the head pivoting axis are all the same.

5. The doll of claim 1 in which the first and second drive means comprise a gear with cam means on opposed faces of the gear.

6. The doll of claim 5 in which the third drive means is a third cam means coaxial with the gear and angularly aligned with the gear.

7. The doll of claim 2 in which the fourth drive means includes channel means on the outside of the torso and a depending offset means connected to the head and engaging the channel means in the torso.

8. The doll of claim 1 in which the pivoting of the head from the first forward position to the second forward position occurs while the second drive means pivots the second leg from the first position to the second position.

9. A doll movable from a face-down prone position on a generally horizontal surface to an upright standing position on the generally horizontal surface comprising:

an elongated torso having an upper end and a lower end;

a motor and drive mechanism housed in the torso;

a pair of legs, each mounted at one end of the leg adjacent the lower end of the torso for pivotal movement with respect to the torso about a leg axis transverse to the length of the torso;

the other end of each leg being formed with a foot having a generally flat bottom;

the foot of each leg being behind the respective leg axis when the doll is in the prone position and forward of the respective leg axis in a sitting position;

a pair of arms, each mounted adjacent the upper end of the torso for pivotal movement with respect to the torso about an arm axis transverse to the length of the torso;

the two arm axes and the head pivoting axis all being the same;

a head mounted atop the upper end of the torso for pivotal movement about a head pivoting axis;

the drive mechanism including first, second and third drive means;

the first drive means initially pivoting a first one of the legs from a first position generally parallel to the length of the torso and with the foot behind the leg axis to a second position alongside the torso with the foot ahead of the leg axis and at least a portion of the foot contacting the surface;

the second drive means then pivoting the second leg from a first position generally parallel to the length of the torso and with the foot behind the leg axis to a second position alongside the torso with at least a portion of the foot contacting the surface ahead of the leg axis;

the first and second drive means together next rotating the torso away from the first and second legs in the second position back to the generally aligned first position; and the third drive means pivoting the head from a first forward position to a second rearward position during movement of the first and second legs from their respective first position to their respective second position and then returning the head from the second rearward position back to the first forward position upon the first and second drive means rotating the torso back to the generally aligned first position with respect to both of the legs.

10. The doll of the claim 9 in which:

the head is also mounted for side-to-side swiveling movement about a head swiveling axis that is not parallel to the head pivoting axis; and the drive mechanism includes fourth drive means to swivel the head upon the third drive means pivoting the head from the second rearward position to the first forward position.

11. The doll of claim 10 in which the fourth drive means includes channel means on the outside of the torso and a depending offset means connected to the head and engaging the channel means in the torso.

12. The doll of claim 9 in which the drive mechanism includes:

an axle;

first cam means mounted on the axle for moving the legs; and second cam means mounted on the same axle for moving the head.

13. The doll of claim 9 in which the first and second drive means comprises a gear with cam means on opposed faces of the gear.

14. The doll of claim 13 in which the third drive means is a third cam means coaxial with the gear and angularly aligned with the gear.

15. A doll movable from a face-down prone position on a generally horizontal surface to an upright standing position on the generally horizontal surface comprising:

an elongated torso having an upper end and a lower end;

a motor and drive mechanism housed in the torso;

a pair of legs, each mounted at one end of the leg adjacent the lower end of the torso for pivotal movement with respect to the torso about a leg axis transverse to the length of the torso;

the other end of each leg being formed with a foot having a generally flat bottom;

the foot of each leg being behind the respective leg axis when the doll is in the prone position and forward of the respective leg axis in a sitting position;

a pair of arms, each mounted adjacent the upper end of the torso for pivotal movement with respect to the torso about an arm axis transverse to the length of the torso;

a head mounted atop the upper end of the torso for pivotal movement about a head pivoting axis;

the drive mechanism including first, second and third drive means;

the first and second drive means comprising a gear with cam means on opposed faces of the gear;

the third drive means being a third cam means coaxial with the gear and angularly aligned with the gear;

the first drive means initially pivoting a first one of the legs from a first position generally parallel to the length of the torso and with the foot behind the leg axis to a second position alongside the torso with the foot ahead of the leg axis and at least a portion of the foot contacting the surface;

the second drive means then pivoting the second leg from a first position generally parallel to the length of the torso and with the foot behind the leg axis to a second position alongside the torso with at least a portion of the foot contacting the surface ahead of the leg axis;

the first and second drive means together next rotating the torso away from the first and second legs in the second position back to the generally aligned first position; and the third drive means pivoting the head from a first forward position to a second rearward position during movement of the first and second legs from their respective first position to their respective second position and then returning the head from the second rearward position back to the first forward position upon the first and second drive means rotating the torso back to the generally aligned first position with respect to both of the legs.

16. The doll of claim 15 in which:

the head is also mounted for side-to-side swiveling movement about a head swiveling axis that is not parallel to the head pivoting axis; and the drive mechanism includes fourth drive means to swivel the head upon the third drive means pivoting the head from the second rear position to the first forward position.

17. The doll of claim 16 in which the fourth drive means includes channel means on the outside of the torso and a depending offset means connected to the head and engaging the channel means in the torso.

18. The doll of claim 15 in which the drive mechanism includes:

an axle;

first cam means mounted on the axle for moving the legs; and second cam means mounted on the same axle for moving the head.

19. The doll of claim 15 in which the two arm axes and the head pivoting axis are all the same.

* * * * *